United States Patent [19]

Thorncraft et al.

[11] Patent Number: 4,949,562

[45] Date of Patent: Aug. 21, 1990

[54] LOCKING DEVICE

[75] Inventors: Irwin C. Thorncraft, Winston Hills; Owen B. Holmes; Harry Wolters, both of Orange, all of Australia

[73] Assignee: Frorest PTY Limited, New South Wales, Australia

[21] Appl. No.: 302,744

[22] PCT Filed: May 18, 1988

[86] PCT No.: PCT/AU88/00150

§ 371 Date: Mar. 17, 1989

§ 102(e) Date: Mar. 17, 1989

[87] PCT Pub. No.: WO88/09421

PCT Pub. Date: Dec. 1, 1988

[30] Foreign Application Priority Data

May 18, 1987 [AU] Australia ..... P12015

[51] Int. Cl.[5] ..... E05B 47/00

[52] U.S. Cl. ..... 70/277; 292/169.19

[58] Field of Search ..... 70/279, 277, 278, 150; 292/169.19, 179, 181

[56] References Cited

U.S. PATENT DOCUMENTS

| | | | |
|---|---|---|---|
| 1,377,061 | 5/1921 | Deeg . | |
| 1,774,636 | 9/1930 | Cook . | |
| 1,997,155 | 4/1935 | Sprecker . | |
| 2,045,186 | 6/1936 | Honsel . | |
| 3,207,273 | 9/1965 | Jurin . | |
| 3,890,608 | 6/1975 | Peterson . | |
| 4,807,455 | 2/1989 | Mauer | 70/277 |

FOREIGN PATENT DOCUMENTS

| | | | |
|---|---|---|---|
| 45091/85 | 7/1985 | Australia . | |
| 0160470 | 10/1986 | European Pat. Off. . | |
| 0248488 | 1/1987 | European Pat. Off. . | |
| 344535 | 11/1936 | Italy | 292/181 |
| 24331 | 1/1971 | United Kingdom . | |

*Primary Examiner*—Robert L. Wolfe

*Attorney, Agent, or Firm*—Hill, Van Santen, Steadman & Simpson

[57] ABSTRACT

A locking device comprising: a bolt (1) provided with a handle mounting block (6) and a handle (15) for movement of said bolt (1); and, a lever (2), adapted to selectively engage said handle mounting block (6) upon activation of an activation means (4, 14); wherein, in a neutral mode (FIG. 3), said lever (2) allows free movement of said bolt (1), in a locking mode (FIG. 5) and upon movement of said handle (15), said handle mounting block (6) may be engaged by said lever (2), and, in locked mode (FIG. 1), said handle mounting block (6) engaged by said lever (2) substantially prevents any movement of said bolt (1).

9 Claims, 8 Drawing Sheets

LOCKING DEVICE

The present invention relates to a locking device, and in particular to a locking device which is capable of being operated by utilising either a conventional key, or by electric pulse activation.

The locking device of the present invention is primarily intended to be used in a safe, however, many other applications wherein there exists a frequent turnover of users of a lock would render the present invention useful. The locking device of the present invention is preferably provided in a cassette-type package such that it may be quickly and easily adapted to a wide variety of applications, for instance, to the doors of hotel rooms, filing cabinets, etc.

By the provision of a keyboard able to accept a code, a user is able to set a new code eachh time the lock is closed, such that the lock cannot be re-opened unless an identical code is re-entered. When the correct code is re-entered, the lock may be opened and the stored code is erased. On the next use, the user is able to set a new code, which may be identical or different to the previously stored code.

By way of illustration only, it is seen that a safe provided with a locking device in accordance with the present invention is extremely advantageous in a hotel room. Each guest is able to insert a new code into the keypad of the lock prior to closing the safe, thus achieving a high degree of security. Not only is the problem of previous users retaining the key to the safe obviated, but the present invention renders it unnecessary for a user to carry the key of the safe, thus avoiding the risk of losing same. Any unauthorised person would have to try his luck and endeavor to find the correct code, however, such attempts would activate associated electronic circuitry to sound alarms and/or block further use of the keypad for a period of time. It is thus seen that the pesent invention provides a secure but versatile locking device which is ideal in situations where there exists a frequent turnover of the users of the locking device. As a backup, for instance if a user forgets his code, the locking device may be key operated. Ideally, this backup key is retained by the hotel manager for use in case of emergency only.

The mechanics of the locking device of the present invention provide three basic modes of operation. A user would find the safe in "neutral mode". In neutral mode, the lock cannot be closed. When a code is entered via a keypad, or a key lock is rotated, the safe is placed in "locking mode", allowing the door to be closed in "locked mode". In the "locked mode", the lock is securely deadlocked preventing any movement of the bolt of the lock. The code is stored until the same code is re-entered or the key is rotated, returning the lock to "neutral mode", allowing the door to be re-opened. The stored code is then erased, allowing the cycle to commence once again, either using the same code or an entirely different code. The entry of the code essentially activates associated electronic circuitry to consequently transmit an electric pulse to a solenoid, which, as will be seen hereinafter, operates the locking device.

The present invention seeks to provide a locking device which is versatile, allowing a plurality of users to operate said locking device, whilst maintaining security.

The present invention also seeks to provide a locking device which is operable by a key and/or a code entered into a keypad.

The present invention also seeks to provide a locking device which is operable by associated electronic circuitry either connected to a mains power supply or a battery.

The present invention also seeks to provide a locking device which is electrically operable by two identical pulses of low level power and extremely short duration and which operates a solenoid to achieve the mechanical operation of the lock, thus providing a lock which uses minimal electric power.

The present invention also seeks to provide a locking device which is constructed in cassette form, allowing the locking device to be utilised in a wide variety of applications.

The present invention also seeks to provide a locking device which is provided with an external flush fitting handle connected to the main bolt via a simple lever system. The handle preferably fits flush with the external face plate whilst the locking device is in the locked mode, and protrudes beyond the face plate in the neutral mode thus giving a simple visual indication to a user of the present mode of the safe.

In one broad form, the present invention provides a locking device comprising:

a bolt provided with a handle mounting block and a handle for movement of said bolt; and, a lever, adapted to selectively engage said handle mounting block upon activation of an activation means;

wherein, in a neutral mode said lever allows free movement of said bolt, in a locking mode and upon movement of said handle said handle block bolt may be engaged by said lever, and, in a locked mode said handle mounting block engaged by said lever substantially prevents any movement of said bolt.

As a preferred embodiment, the present invention also provides a locking device, comprising a bolt movable along the longitudinal axis thereof between locked and unlocked positions, said bolt being supported by a pair of supports at substantially the ends thereof, and having a handle mounting block provided in substantially the centre thereof, said bolt having a pair of springs therearound, each spring located between one side of said handle mounting block and a respective one of said supports, such that said pair of springs normally bias said bolt into an unlocked position;

a first lever, a first end thereof being provided with a cutout adapted to engage said handle mounting block, and a second end thereof being provided with a protrusion, said first lever being pivotally biased about a first pivot point;

a second lever, a first end thereof being provided with first and second retention means adapted to engage with said protrusion, sid second lever adapted to be moved by at least one activation means about a second pivot point;

said first end of said second lever being biased towards said second end of said first lever; and said activation means being provided to cause said second lever to rotate about said second pivot point against the bias thereof;

said locking device operating between three cyclic modes, wherein:

in a neutral mode, said first retention means of said second lever retains said protrusion of said first lever to prevent lever from contacting said handle mounting block, consequently allowing unrestricted movement of said bolt;

in a locking mode, said first lever is unretained by said second lever such that upon movement of said handle, said handle mounting block contacts an edge of a said cutout and moves said first lever such that said protrusion engages and is retained by said second retention means, and simultaneously, said handle mounting block becomes engaged and retained by said cutout of said first lever;

in a locked mode, said protrusion of said first lever is retained by said second retention means of said second lever, and movement of said handle mounting block is restricted by said cutout, firmly maintaining said bolt in said locked position;

wherein, said locking device is transferred from said neutral mode to said locking mode and from said locked mode to said neutral mode by activation of said activation means.

In a further form, the present invention provides a method for operating a locking device as claimed in claim 6 comprising the continuously cyclic steps of:

supplying a locking code to said keypad such that said locking code may be memorised by said electronic circuitry and said electronic circuitry supplies a signal to said solenoid to place said locking device from said neutral mode to said locking mode;

moving said handle such that said bolt is placed from said unlocked position to said locked position and said locking device is placed in said locked mode;

supplying an opening code to said keypad such that said electronic circuitry compares said opening code to said locking code, and, if said codes are identical, said electronic circuitry supplies a further signal to said solenoid to transfer said locking device from said locked mode to said neutral mode and to move said bolt to said unlocked position.

The present invention will become more fully understood from the following detailed description thereof, in connection with the accompanying drawings, in which.

Figure 1:
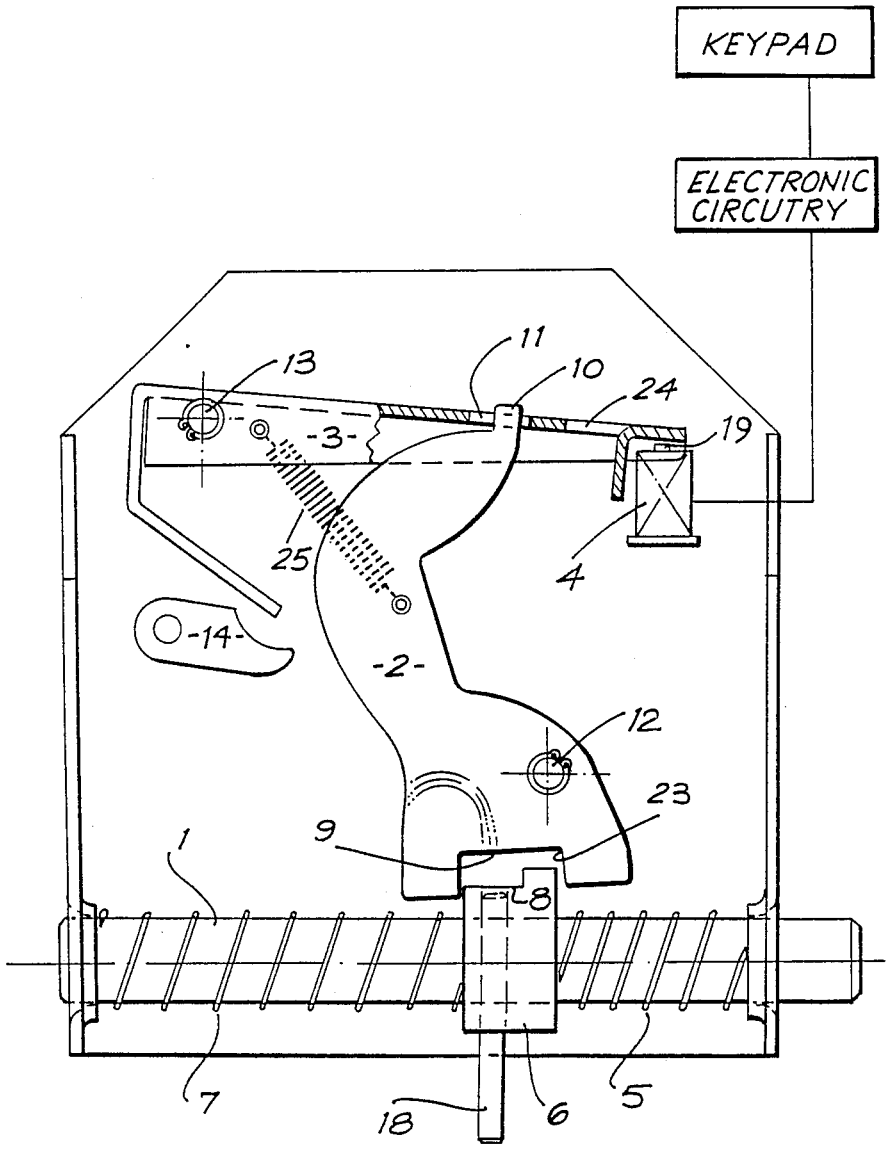
FIG. 1 shows an elevational view of a preferred embodiment of the locking device in accordance with the present invention whilst in the locked mode.
Figure 3:
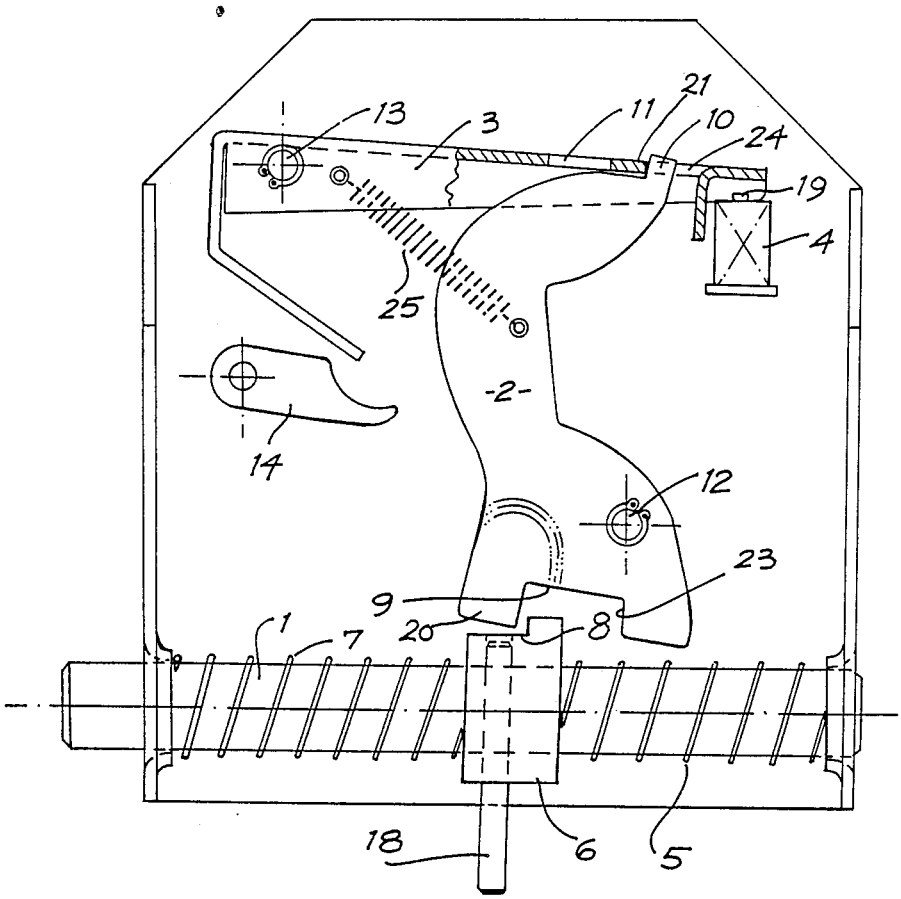
FIG. 3 illustrates an elevational view of the locking device in neutral mode after pulse activation of the solenoid.

In FIG. 1, an elevational view of a lock in accordance with a preferred embodiment of the present invention is shown in the locked position, comprising a main bolt 1 which has a handle mounting block 6 permanently affixed to substantially the centre thereof. On either side of the handle mounting block 6 are provided springs 5 and 7, which normally bias the main bolt 1 to a neutral mode, whereby the bolt is maintained in an unlocked position (as shown in FIG. 3). The handle mounting block 6 is provided with a stepped surface 8 and engages with a cutout 9 of lever 2. The other end of lever 2 is provided with a protrusion 10 which is machined to engage with notches 11 and 24 of lever 3. Each of levers 2 and 3 are pivotally affixed about pivot points 12 and 13 respectively. Also, lever 3 is spring biased in the clockwise direction, and lever 2 is spring-biased in the anti-clockwise direction. This spring bias is preferably achieved by means of the single spring 25. FIG. 1 also shows a solenoid 4 an d a key lock tongue 14. Each of the solenoid 4 and the key lock tongue 14 may be used separately to pivot the lever 3 about pivot point 13 to consequently achieve the mechanical operation of the lock, as will be hereinafter described.

Figure 2:
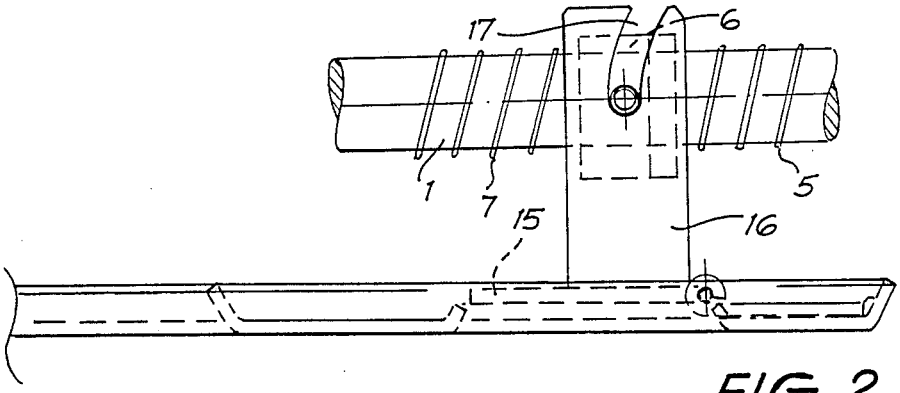
FIG. 2 shows a plan view of the lock as shown in FIG. 1, primarily illustrating the position of the handle.

In FIG. 2, is shown a plan view of the lock as shown in FIG. 1. This figure details the main bolt 1, and its inter connection to the external handle 15. The handle 15 is shown secured to a link 16, which itself is provided with a cutout 17 which engages with the handle mounting block 6 by means of extension 18. FIG. 2 shows the handle in the closed position with the handle mounting block 6 and the main bolt 1 consequently being in the locked position. Upon actuation of the solenoid 4 or turning of the key 14, spring 5 forces the mounting block 6 rearwardly, such that the handle 15 automatically moves to the position of FIG. 4, which will be described hereinafter.

In the locked position, as shown in FIG. 1, the protrusion 10 of lever 2 is engaged with the edge of the notch 11 of lever 3. The cutout 9 at the other end of lever 2 is engaged with the handle mounting block 6 such that any movement of the main bolt 1 is substantially prevented. The locking device is thus deadlocked. To release the locking device from this deadlock position one of the two distinct methods of operations may be implemented. The locking function may be controlled either by activating the electrical solenoid 4 by means of a keypad, or, by conventional key operation to turn the key lock tongue 14. Each method will be described separately hereinbelow.

In FIG. 3, is shown the neutral mode of the lock which is may be achieved by activation of the solenoid 4. By supplying an electrical pulse to the solenoid 4, the lever 3 is momentarily attracted or repelled to the solenoid 4 contacts 19 depending on the positioning of the solenoid 4. A configuration whereby the solenoid 4 repels lever 3 is shown in FIG. 3, the repelling of the lever 3 causing the lever 3 to pivot in the anti-clockwise direction about pivot point 13, such that the notch 11 is raised to consequently disengage from the protrusion 10 of lever 2. Under action of the primary spring 5, the main bolt 1 and the handle mounting block 6 are free to move rearwardly since they are now unimpeded by the lever 2. During this rearward movement of the main bolt 1, the lever 2 is forced into a position, as shown in FIG. 3, wherein the end 20 of the lever 2 comes to rest on or above the step 8 of the handle mounting block 6. Under action of spring bias, the lever 3 moves in a clockwise position such that the end 21 of the lever 3 engages the side of the protrusion 10 of the lever 2 and ensures that the lever 2 is impeded from further anti-clockwise movement, and consequently prevents the main bolt 1 and the handle mounting block 6 from being retained. That is, the main bolt 1 can, via the external handle 15, and the joint 16 to the handle mounting block 6 be moved forward or rearward, but cannot be dead-locked. The expensive force of the primary spring 5, together with the secondary spring 7 retract the main bolt 1 and maintain same in this neutral mode.

Figure 4:
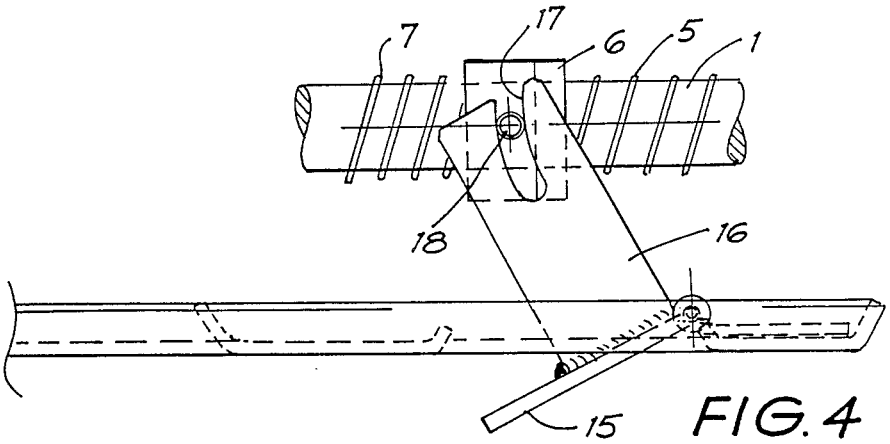
FIG. 4 shows a plan view of the lock as shown in FIG. 3.

In FIG. 4 is shown a plan view of the neutral mode as displayed in FIG. 3. FIG. 4 details the position of the handle in such a neutral mode. The handle may be forced to the closed position, however, the action of the springs 5 and 7 tend to maintain the main bolt 1, and consequently the handle 15 in theopen position until further activation of the solenoid acts to restrict this movement.

Figure 5:
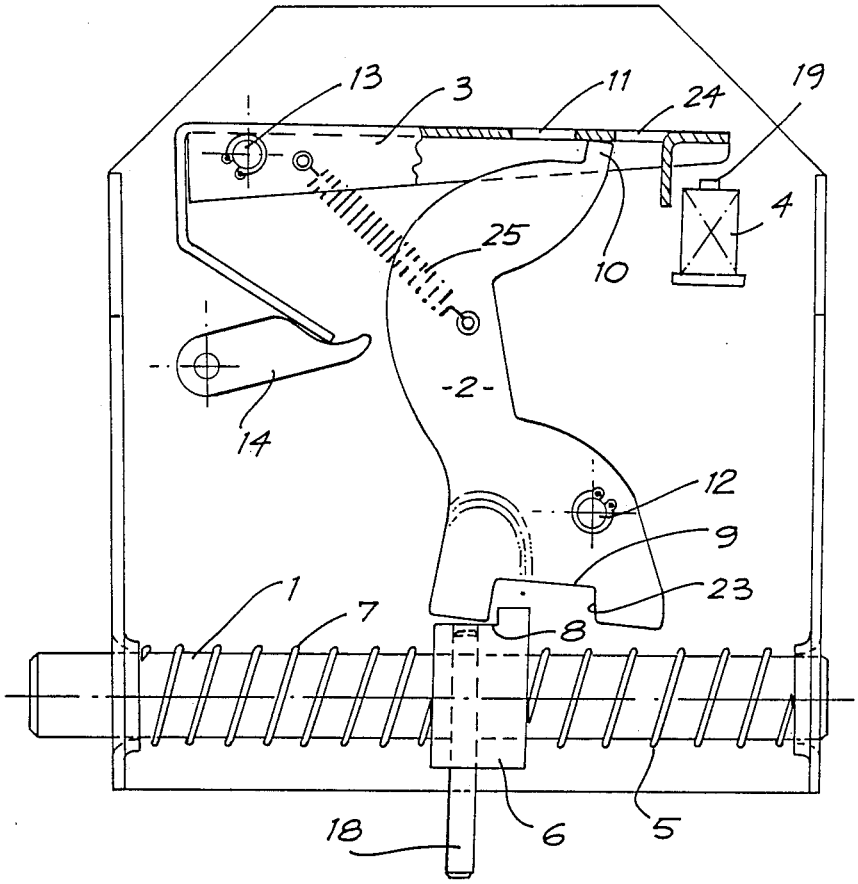
FIG. 5 illustrates an elevational view of the locking device in locking mode after further pulse activation of the solenoid.

In FIG. 5 is shown the position of the lock after further activation of the solenoid 4. By supplying a further electrical pulse to the solenoid 4, the lever 3 again becomes momentarily repelled by the contacts 19 of the solenoid. This repulsion of the lever 3 causes the lever 3 to pivot once again about pivot point 13 such that the end 21 of the lever 3 is raised, allowing the lever 2 to pivot anti-clockwise about pivot point 12, under the action of the anti-clockwise spring bias of the lever 2.

Lever 2 pivots until the end 20 is impeded by the step 8 of the handle mounting block 6, such that the end 21 of lever 3 rests on the top of the protrusion 10 of lever 2, as shown in FIG. 5. By closing the handle 15, the handle mounting block 6 and the main bolt 1 are moved in the forward direction such that the edge 23 of the cutout 9 of lever 2 engages with the top step of the handle mounting block 6, consequently rotating the lever 2 in the anti-clockwise direction until the protrusion 10 of the lever 2 engages with the notch 11 of the lever 3, thus restricting any further movement of the lock and maintaining the lock in the dead-locked position as shown in FIG. 1.

Figure 6:
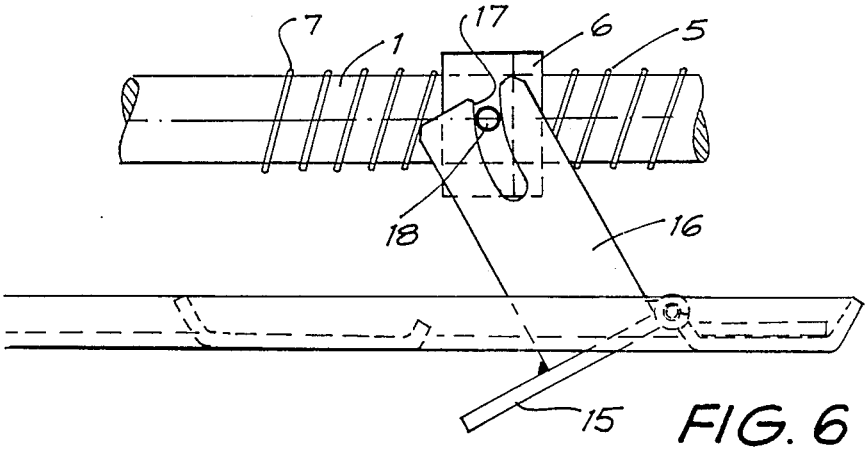
FIG. 6 shows a plan view of the lock as shown in FIG. 5.

In FIG. 6 is shown the position of the handle 15 whilst in this locking mode as described with reference to FIG. 5. FIG. 6 shows a similar position to FIG. 4, however, if the handle 15 is closed in this locking mode, the handle mounting block 6 is moved to the position of FIG. 2, wherein any further movement is prevented.

As previously discussed, the locking device may be released from the dead-locked position of FIGS. 1 and 2, by means of a conventional key operation. Instead of utilising the solenoid 4 to enable movement of the lever 3, the key lock tongue 14 is utilised for this purpose.

Figure 7:
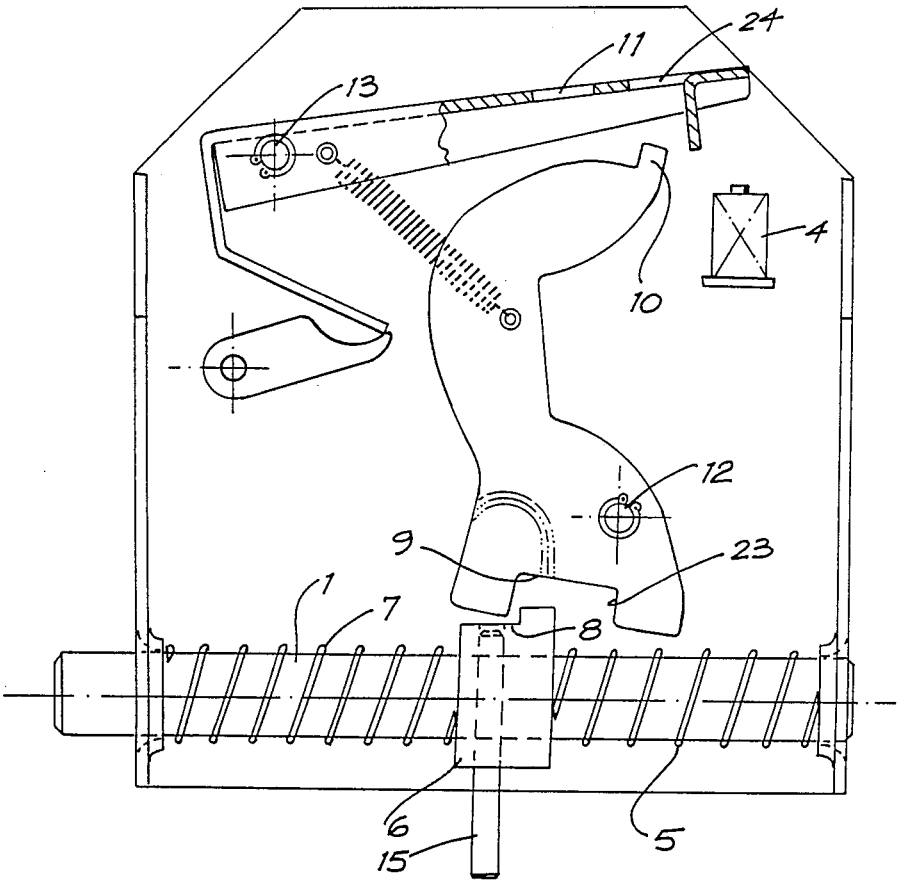
FIG. 7 illustrates the operation of locking and unlocking the device by means of a key.

In FIG. 7, is shown the operation of locking and unlocking the locking device by means of a key. The key lock tongue 14 is rotated clockwise or anti-clockwise by means of a key, such that the end 22 of the lever 3 is engaged to consequently rotate the lever 3 about pivot point 13. To achieve the unlocking function of the locking device the key lock tongue 14 is turned to the anti-clockwise position as shown in FIG. 7, the end 21 of the lever 3 being raised as shown. The main bolt 1 can then be freely moved forward and backward by the handle 15 via the handle mounting block 6, the lever 2 also freely rotating around pivot point 12. To dead-lock the main bolt 1, the key is turned such that the key lock tongue 14 is removed from engagement with the end 22 of lever 3. The handle 15 is then closed such that the handle mounting block 6 engages with cutout 9 of the lever 2, causing the lever 2 to rotate anti-clockwise allowing the protrusion 10 of the lever 2 to engage with the notch 11 of the lever 3. The lock is thus secured in the dead-locked position, as shown in FIG. 1.

Figure 8:
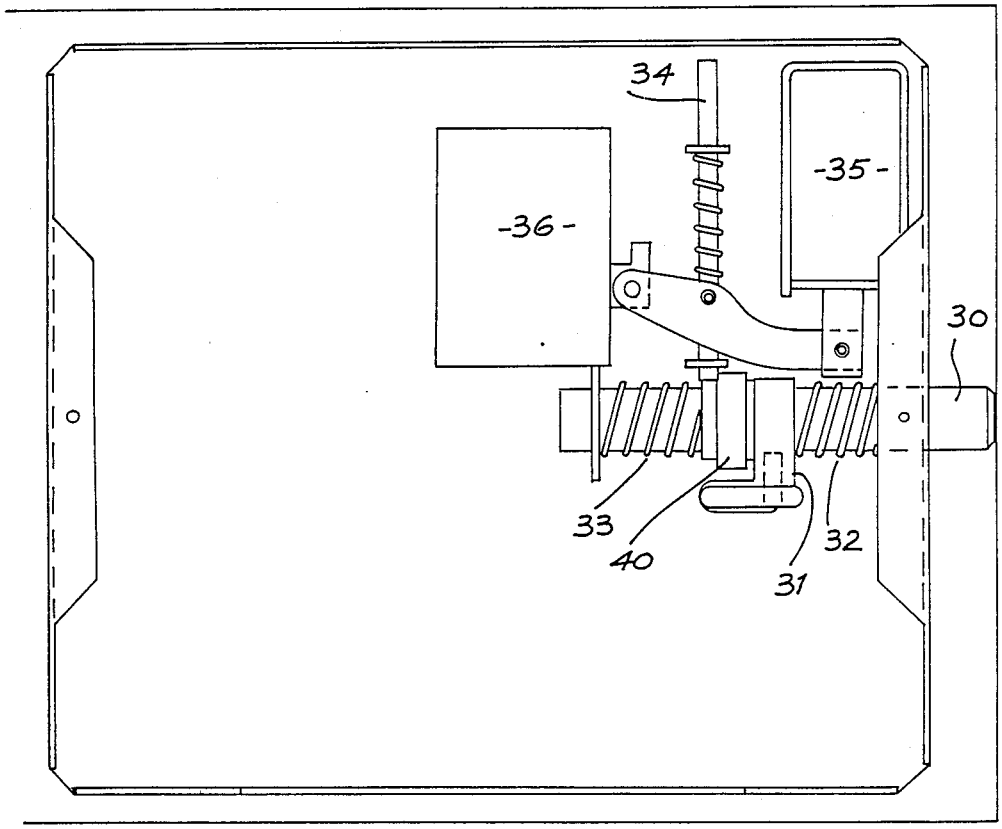
FIG. 8 shows an elevational view of a second embodiment of the locking device of the present invention, in the locked position.

In FIG. 8 is shown a second embodiment of a locking device in accordance with the present invention. This embodiment of the locking device comprises a main bolt 30, a handle mounting block 31, two springs 32 and 33 on either side thereof, and a spring loaded plunger 34 adapted to engage said handle mounting block 31. The spring loaded plunger is activated by either the solenoid 35 or the key lock 36 via the lever 39.

Figure 9:
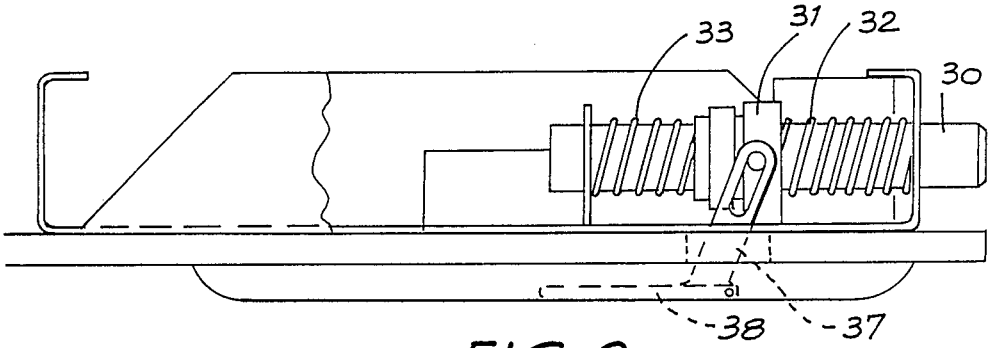
FIG. 9 shows a plan view of the embodiment of FIG. 8.

In FIG. 9 is shown a plan view of the locking device as shown in FIG. 8. FIG. 9 shows the handle 38 interconnected to the handle mounting block 31 via the lever 37, in a similar configuration to the embodiment of FIGS. 1 to 7.

Figure 10:
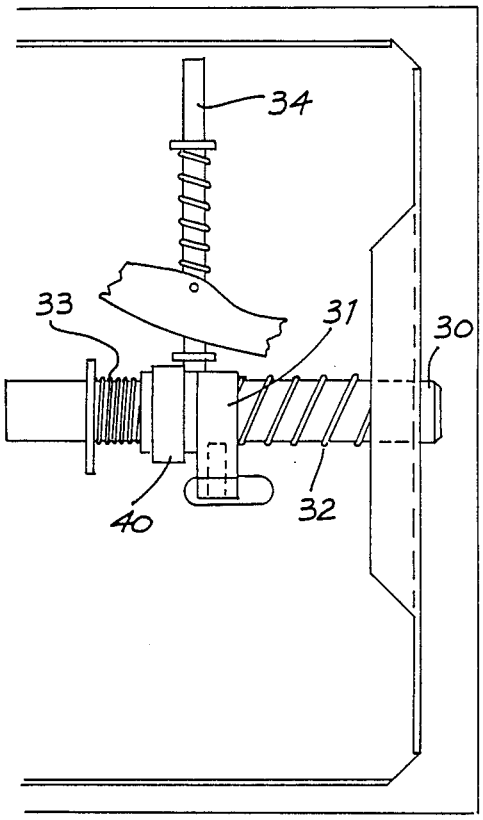
FIG. 10 shows a elevational view of the second embodiment of the locking device in the unlocked mode.

In FIG. 10 is detailed the position of the spring loaded plunger whilst the lock is in the neutral mode. The plunger retains the sliding sleeve 40, allowing the main bolt 1 to move freely rearward or forward via handle 38.

Figure 11:
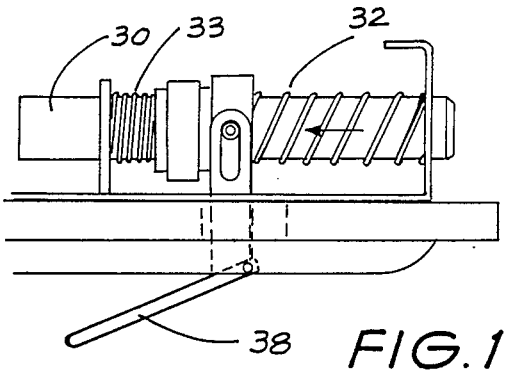
FIG. 11 shows a plan view of the locking device as shown in FIG. 10.

In FIG. 11 is shown a plan view of the locking device as shown in FIG. 10, in neutral mode, illustrating the handle 38 in the open position.

Figure 12:
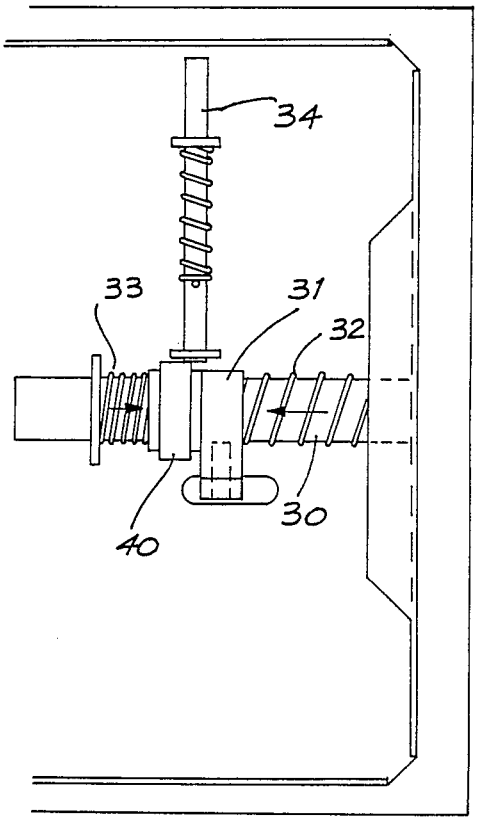
FIG. 12 shows an elevational view of the locking device in locking mode.

In FIG. 12 is shown an elevational view of the locking device in locking mode. The operation of this embodiment of the locking device of the present invention will be hereinbelow described with reference to FIGS. 8 to 12.

In the locked position the main bolt 30 is retained by means of a spring loaded plunger 34, thus providing a dead-locking function. On receipt of a signal from the activation device, that is, either solenoid 35 or key lock 36, the spring loaded plunger enters a neutral mode allowing the main bolt to be freely operated in either direction i.e. unrestricted movement of the bolt. This ensures that the mechanism cannot be locked in this mode as shown in FIG. 10. Upon receipt of a second activation of the key lock or solenoid the spring loaded plunger can re-assume latching position. This returns the bolt back to the locking position, whereby, once again positive dead-locking of the mechanism is possible.

This total range of functions is provided by virtue of a sleeve 40 mounted on the main bolt 30. Its operation is such that, in locked position the spring loaded plunger is retained behind the sleeve 40, which, coupled with the handle mounting block 31, provides the dead-locking system as shown in FIG. 8. Activation of the solenoid or key lock withdraws the spring loaded plunger 34 therefore allowing the primary spring 32 on the main bolt to withdraw to the bolt 30, the handle 38, and the sleeve 40 into the open position. In this position the spring loaded plunger 34 is retained in front of the sliding sleeve 40, as shown in FIG. 10.

Forward movement of the bolt, by depressing the handle 38 allows the handle mounting block 31 and hence the main bolt 30 to move forward. However, a pressure from the primary spring 32 forces the bolt back, preventing the mechanism from reaching the dead-lock position. Upon receipt of the second signal, from either the solenoid or the key, the spring loaded plunger is once again withdrawn allowing the secondary spring on the main bolt to move the sliding sleeve forward, so that the spring loaded plunger rests in a neutral position on sleeve 40 as shown in FIG. 12. From here depression of the handle 38 and the main bolt 30 allows the main bolt and sliding sleeve 40 to move forward to a position where the spring loaded plunger can re-engage behind the sliding sleeve, therefore returning the mechanism to the dead-lock position of FIG. 8.

The present invention has been herein described with reference to two preferred embodiments, however it should be understood that numerous other variations and modifications can be made to the locking device according to the present invention.

One embodiment has been herein described comprising a solenoid 4 to achieve electronic activation of the lock such as to move the lever 2. It should be understood that any device capable of rotating lever 3 could be utilised, such as, but not limited to, a rotating cam, without departing from the scope of the invention. Furthermore, the above mentioned embodiment described a keypad by which a code may be entered to operate associated electronic circuitry, and thus activate the solenoid. Numerous alternatives are obviously possible, such as, but not limited to, utilising an infra-red remote control device, or a finger print reading device. Variations are also possible to the mechanical components of the lock as well as any above-mentioned associated components. For instance, when desired, such as in cases of extreme security, the main bolt may be replaced by more than one bolt, either in the same axial direction, or in a plurality of directions.

Figure 13:
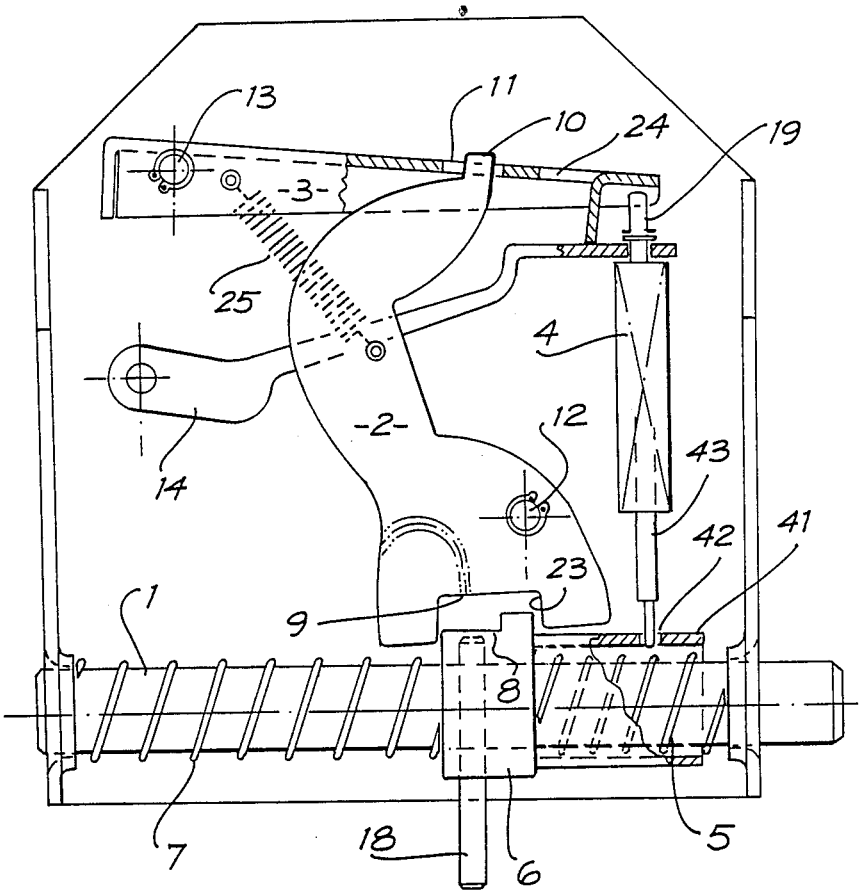
FIG. 13 illustrates a variation to the embodiment of FIGS. 1 to 7, providing a 'back-up' to the dead-locking function of the locking device.

In FIG. 13, is shown an alternative embodiment of the present invention. This embodiment is a variation of that of FIG. 1, in that a shroud, 41 is provided around the bolt 1, extending from the handle mounting block 6. The shroud 41 is provided with a perforation 42, into which an arm 43, affixed to the contacts 19 of the solenoid 4, is adapted to engage. That is, the arm 43 is adapted to move in direct relationship with the contacts 19 of the solenoid. With the arm 43 engaed in the perforation 42, a 'back-up' of the dead-locking function is achieved. this 'back-up' ensures that the spring 25 cannot be overriden such that the locking device may be removed from the locked mode by strong mechanical vibration or the like. With such variations, it is also necessary to make consequential variations to the key lock tongue 14 such that a key may be utilised to open the safe. To achieve this, the key lock tongue 14 may be extended or repositioned such that it is adapted to connect to the movable arm 43 or the contacts 19 of the solenoid.

While particular embodiments of this invention have been described, it will be evident to those skilled in the art that the present invention may be embodied in other specific forms without departing from the essential characteristics thereof. The present embodiments and examples are therefore to be considered in all repects as illustrative and not restrictive, the scope of the invention being indicated by the appended claims rather than by the foregoing description, and all changes which come within the meaning and range of equivalency of the claims are therefore intended to be embraced therein.

We claim:

1. A locking device comprising:

a bolt provided with a handle mounting block and a handle for movement of said bolt; and a lever, adapted to selectively engage said handle mounting block upon activation of an activation means;

wherein, in a neutral mode said lever allows free movement of said bolt and prevents said bolt from assuming a locking position, in a locking mode and upon movement of said handle, said handle mounting block may be engaged by said lever, and, in a locked mode said handle mounting block engaged by said lever substantially prevents any movement of said bolt.

2. A locking device as claimed in claim 1, wherein said bolt is provided with a pair of springs on either side of said handle mounting block which normally bias said bolt into an unlocked or retracted position.

3. A locking device as claimed in claim 2, wherein said bolt is moved into a locked position by movement of said handle against the action of the normal bias of said pair of springs.

4. A locking device, comprising:

a bolt movable along the longitudinal axis thereof between locked and unlocked positions, said bolt being supported by a pair of supports at substantially the ends thereof, and having a handle mounting block provided in substantially the centre thereof, said bolt having a pair of springs therearound, each spring located between one side of said handle mounting block and a respective one of said supports, such that said pair of springs normally bias said bolt into an unlocked position;

a first lever, a first end thereof being provided with a cutout adapted to engage said handle mounting block, and a second end thereof being provided with a protrusion, said first lever being pivotally biased about a first pivot point;

a second lever, a first end thereof being provided with first and second retention means adapted to engage with said protrusion, said second lever adapted to be moved by at least one activation means about a second pivot point;

said first end of said second lever being biased towards said second end of said first lever; and said activation means being provided to cause said second lever to rotate about said second pivot point against the bias thereof;

said locking device operating between three cyclic modes, wherein:

in a neutral mode, said first retention means of said second lever retains a said protrusion of said first lever to prevent said first lever from contacting said handle mounting block, consequently allowing unrestricted movement of said bolt;

in a locking mode, said first lever is unretained by said second lever such that upon movement of said handle, said handle mounting block contacts an edge of a cutout and moves said first lever such that said protrusion engages and is retained by said second retention means, and simultaneously, said handle mounting block becomes engaged and retained by said first cutout of said first lever;

in a locked mode, said protrusion of said first lever is retained by said second retention means of said second lever, and movement of said handle mounting block is restricted by said cutout, firmly maintaining said bolt in said locked position;

wherein, said locking device is transferred from said neutral mode to said locking mode and from said locked mode to said neutral mode by activation of said activation means.

5. A locking device as claimed in any one of claims 1 to 4, wherein said activation means is a key-operated and/or a solenoid-operated device.

6. A locking device as claimed in claim 5, wherein said solenoid-operated device is controlled by electronic circuitry in response to a keypad operation.

7. A locking device as claimed in claim 1 wherein said handle fits flush with an external face plate of said locking device.

8. A method for operating a locking device as claimed in claim 6 comprising the continuously cyclic steps of:

supplying a locking code to said keypad such that said locking code may be memorised by said electronic circuitry and said electronic circuitry supplies a signal to said solenoid to place said locking device from said neutral mode to said locking mode;

moving said handle such that said bolt is placed from said unlocked position to said locked position and said locking device is placed in said locked mode;

supplying an opening code to said keypad such that said electronic circuitry compares said opening code to said locking code, and, if said codes are identical, said electronic circuitry supplies a further signal to said solenoid to transfer said locking device from said locked mode to said neutral mode and to move said bolt to said unlocked position.

9. A method for operating a locking device as claimed in claim 8 wherein a coin or token operated device must initially be operated prior to activation of said electronic circuitry in said neutral mode.

* * * * *